United States Patent [19]

Edwards et al.

[11] 4,448,325

[45] May 15, 1984

[54] CONTAINER CLOSURE

[75] Inventors: Cyril K. Edwards, Oadby; Edward H. Webb, Dunchurch, near Rugby, both of England

[73] Assignee: Thomas Hunter Limited, Warwickshire, England

[21] Appl. No.: 397,070

[22] Filed: Jul. 12, 1982

[30] Foreign Application Priority Data

Jul. 10, 1981 [GB] United Kingdom ..... 8121325

[51] Int. Cl.[3] ..... B65D 17/34

[52] U.S. Cl. ..... 220/269; 220/271; 220/258; 220/367

[58] Field of Search ..... 220/260, 257, 258, 269, 220/270, 271, 367; 215/307

[56] References Cited

U.S. PATENT DOCUMENTS 4,135,637 1/1979 Hannula ..... 220/271

*Primary Examiner*—George T. Hall

*Attorney, Agent, or Firm*—Murray Schaffer

[57] ABSTRACT

The closure includes a pressure equalization element which can be manipulated to expose an aperture (17) in the closure (10) and thereby allow pressure in the head-space of the container to adjust to ambient pressure. The element has an upper member (21*a*) which overlies the aperture and a lower member (21*b*) adhered to the underside of the closure so as to lie beneath the aperture and which is connected by a connecting member (27) to the upper member.

9 Claims, 11 Drawing Figures

CONTAINER CLOSURE

The invention relates to closures for containers and is particularly concerned with closures which include a element which can be manipulated to relieve pressure in the headspace between the closure and the contents of the container.

A closure having such an element is known from British Pat. No. 1,181,555. The element takes the form of a flexible sealing patch on the upper surface of the cap which normally seals a plurality of apertures formed in the cap. To break the vacuum in the headspace, the patch is lifted to uncover one of the apertures. The patch is, however, retained on the cap so that the uncovered aperture can be re-sealed by light pressure on the cap. With such a cap, the undersides of the apertures in the cap are not protected against chemical attack from the contents of the container which can result in corrosion. Moreover the patch offers little resistance to accidental lifting, say, during hoppering.

An object of the invention is to provide an improved closure and according to the invention, there is provided a closure for a container including an element which can be manipulated to expose an aperture in the closure and thereby allow pressure in the headspace to adjust to ambient pressure, the element including a member on the upper surface of the closure characterised in that a lower member is provided which adheres to the undersurface of the closure thereby sealing the aperture and protecting it from chemical attack from the contents of the container, said lower member being connected to the upper member through the aperture. Not only does such an arrangement protect the aperture against attack but accidental lifting of the upper member is minimised by the connection between the upper and lower members.

Figure 1:
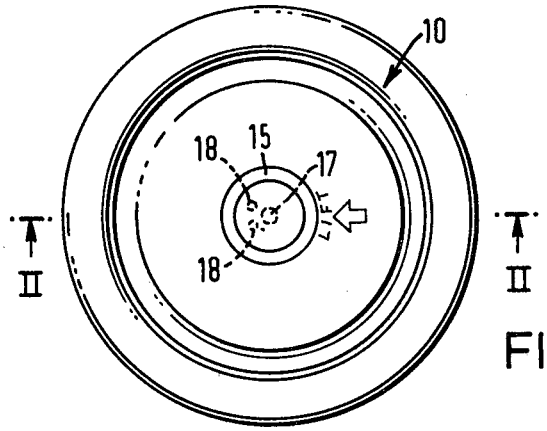
Figure 2:
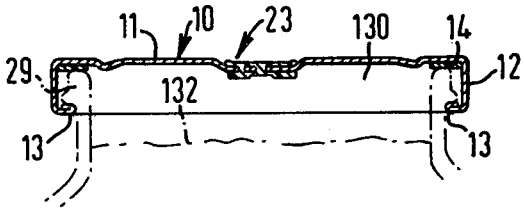
Figure 3:
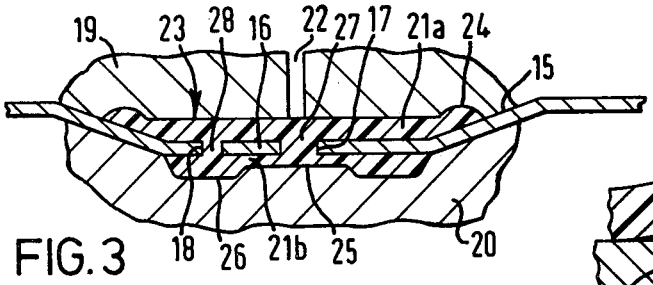
Figure 4A:
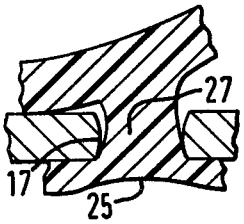
Figure 4:
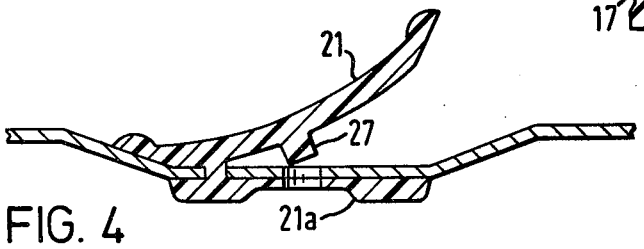
Figure 5:
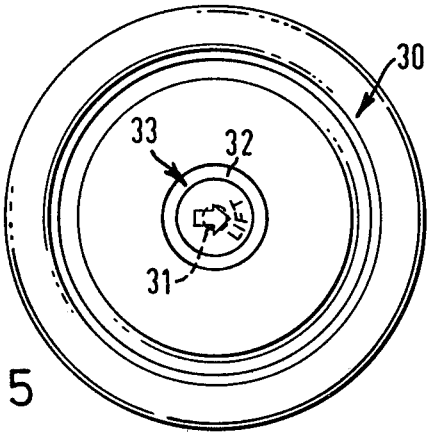
Figure 6:
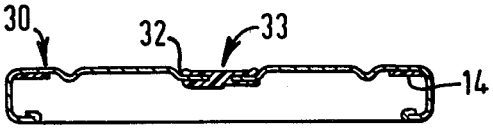
Figure 7:
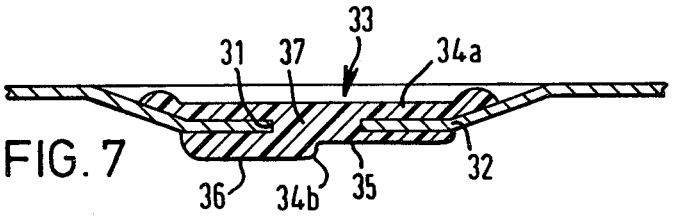
Figure 8:
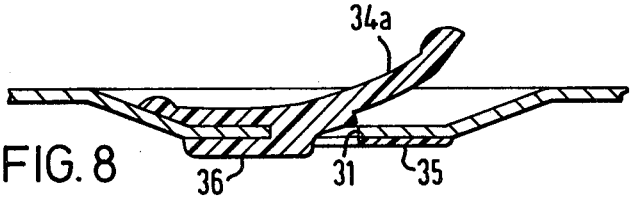
Figure 9:
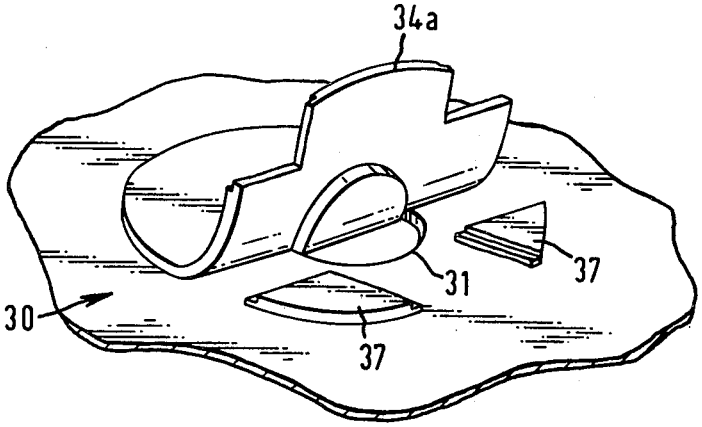
Figure 10:
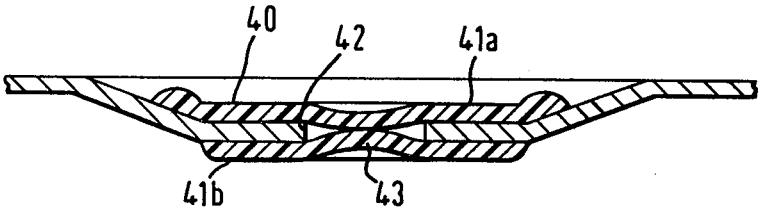

Closure caps in accordance with the invention will now be described by way of example with reference to the accompanying drawings in which:

FIG. 1 is a plan view of a lug cap in accordance with the invention having one form of element which can be manipulated to expose an aperture in the cap, FIG. 2 is a cross-section of the cap shown in FIG. 1 on the line II—II in FIG. 1, FIGS. 3 and 4 are enlarged cross-sections on the line II—II showing the element in a sealing condition and in a condition allowing pressure equalisation to take place, FIG. 4*a* is an enlarged cross-section showing tension applied to the member connecting the upper and lower members of the element, FIGS. 5 to 8 are views similar to FIGS. 1 to 4 illustrating a lug cap having an alternative form of element, FIG. 9 is a perspective view of part of a lug cap provided with an element having portions which are torn when the element is manipulated to expose the aperture, and FIG. 10 is a cross-section through part of a lug cap having another type of element.

Referring first to FIGS. 1 to 4*a* a cap 10 comprises a top 11 having a skirt 12 formed with inwardly directed lugs or nibs 13. The underside of the top 11 is provided with a sealing gasket 14.

The top 11 is formed with preferably a central recess 15 having a circular bottom section 16. The section 16 is formed with a central aperture 17 and two offset relatively smaller apertures 18.

An element 23 is provided on the cap by placing the cap between upper and lower mould parts 19, 20 respectively (FIG. 3). Liquid plastics material is then introduced into the mould through a bore 22 so that it passes through the apertures 17, 18 and completely fills the mould. The mould parts are subsequently removed leaving the element 23 in the form shown in cross-section in FIG. 3.

An upper member 21*a* of the element 23 has a thickened rim 24 and the lower member 21*b* of the element comprises a thin section 25 extending beneath the aperture 17 and a relatively thick circumferential section 26 which lies beneath apertures 18. The upper and lower members of the element are interconnected through the apertures by a plastics connecting member 27 formed within aperture 17 and plastics retaining members 28 formed within apertures 18.

The lower member 21*b* sealingly engages the underside of section 16 and the cap can be applied to the neck ring 29 (FIG. 2) of a container in the usual way with a vacuum in the headspace 130 between the cap 10 and contents 132 packed into the container. To release the vacuum so that the cap can easily be removed, the upper member 21*a* is lifted by inserting a thumbnail/fingernail underneath the rim 24 where indicated by an arrow (FIG. 1) on the cap and lifting as in FIG. 4. As the upper member is progressively separated from the cap, the connecting member 27 is subjected to a tensile force which reduces its cross sectional area and thereby brings it out of close contact with aperture 17 (FIG. 4*a*) and simultaneously exerts an increasing shear force on the section 25 causing it to rupture and to release the vacuum in the headspace. The shear strength of section 25 is less than that of section 26 and of upper member 21*a* so that the retaining members 28 prevent complete separation of the upper and lower members and the connecting member 27 is retained on the upper member. Although there will be a certain amount of resilience in the lifted upper member it will be unsufficient to urge the member back into its original position even if the connecting member 27 is reinserted by manual pressure into the aperture 17. The feature is particularly useful in that the upper member, once lifted, will remain distorted and will provide irrefutable evidence that tampering has occurred and that vacuum has been released.

Referring now to FIGS. 5 to 8, a cap 30 is similar to the cap 10 except that it has a single aperture 31 in a central section 32. An element 33 is moulded using a similar method to that described above to provide an upper member 34*a*, a lower member 34*b* having a thin section 35 extending part-way beneath aperture 31 and a relatively thicker section 36 extending beneath the remainder of the aperture, and a connecting member 37. When the upper member 34*a* is lifted at a point indicated by an arrow shape moulded therein (FIG. 5) the connecting member is subjected to tension and the portion thereof above thin lower member 35 is urged out of close contact with the wall of aperture 31 and eventually ruptures the lower member as in FIG. 8. However, the thick section 36 having greater shear strength remains intact and retains the element on the cap. As with FIGS. 1 to 4*a* the element will provide a dual role in that it facilitates easy removal of the cap and provides evidence of tampering.

Additional evidence of tampering may be provided by using an adhesive to glue down sectors 37 of upper member 34*a* as in FIG. 9. When the upper member is lifted it tears and leaves the sectors on the cap. Alternatively the upper member may stretch away from the sectors 37 as it is lifted. A similar facility may be applied to the arrangement in FIGS. 1 to 4*a*.

In FIG. 10 the element 40 comprises upper and lower members 41*a*, 41*b* which are formed by moulding plastics material as two separate layers on the upper and lower surfaces of the cap. The two layers enter a central aperture 42 in the cap and integrate so as effectively to form a connecting member at 43. The lower member 41*b* is thinner than the upper member at 43 so that on lifting the upper member the lower member will rupture to release the vacuum in the headspace. The sector arrangement of FIG. 9 may also be applied to this embodiment.

It is well known that closure removal torque is affected by pressure in the container headspace. By using a closure cap in accordance with the invention it is possible to encourage high removal torque when pressure is present in the container headspace thereby benefitting in terms of closure security on the container and effective tamper/pilfer proofing until such times when the end user, wanting evidence of pack integrity and requiring easy removal, lifts the pressure element to enable the pressure in the headspace to adjust to the ambient pressure.

In each of the embodiments described the lower member adheres to the underside of the cap. Such adhesion prevents any part of the lower member dropping into the contents of the container when it is ruptured.

The element is also useful in that once the pressure has been released, the upper member still covers the opened aperture to prevent ingress of foreign matter.

Although specific reference has been made in the description to lug caps the element can be applied to a can end or any form of closure where it is desirable or essential to relieve the pressure prior to removing the closure.

Whilst the upper members of the element are shown as being circular they could be of other shape.

The aperture exposed by manipulating the element, e.g. aperture 17 in FIG. 1 may be of a size to allow convenient access to the contents e.g. by means of a drinking straw or by pouring, without removal of the closure.

The term "pressure" used in the description and appended claims embraces "vacuum", the latter being a pressure below atmospheric pressure.

The plastics used to make the element may be PVC.

What we claim as our invention and desire to secure by Letters Patent in the United States is:

1. A closure for a container including an element which can be manipulated to expose an aperture in the closure and thereby allow pressure in the headspace to adjust to ambient pressure, the element including an upper member on the upper surface of the closure and a lower member adhered to the underside of the closure thereby sealing the aperture and protecting it from chemical attack from the contents of the container, said lower member being connected to the upper member through the aperture and having its shear strength varied so that a section thereof will shear easily to release the pressure in the headspace whilst another section has higher resistance to shear and will retain the upper member on the closure after the upper member has been manipulated to release the pressure.

2. A closure according to claim 1 in which the upper member of the element is connected to the lower member by means of a connecting member which occupies the aperture, the element being so constructed that when the upper member is progressively separated from the closure the connecting member is subjected to a tensile force which reduces its cross-sectional area and thereby brings it out of close contact with the wall of the aperture and simultaneously exerts an increasing shear force on the lower member causing it to rupture and release the pressure in the headspace.

3. A closure according to claim 1 in which the section having the lower resistance to shear extends part way beneath the aperture and the section having the higher resistance to shear extends beneath the remainder of the aperture.

4. A closure according to claim 1 in which the closure is formed with one or more further apertures which are sealed by the element and through which the upper member is connected to the high shear strength section of the lower member, the section having lower resistance to shear extending beneath the first said aperture.

5. A closure according to claim 1 in which the upper member is so constructed that when it is manipulated at least one section of it is torn or stretched to provide visible evidence of its having been manipulated.

6. A closure according to claim 1 in which the upper member is joined directly to the lower member through the aperture and the relative strengths of the upper and lower members are such that when the upper member is separated from the closure some part of the lower member is ruptured.

7. A closure according to claim 1 in which the closure requires a twisting action to remove it from a neckring of the container, the closure being highly resistant to manual removal before pressure in the headspace is released by manipulation of the element and the upper member of the element remaining distorted after such manipulation to provide visible evidence of manipulation.

8. A closure according to claim 1 in which the aperture through which pressure can be relased is dimensioned to provide access to the container contents without removal of the closure from the container.

9. A closure according to claim 8 in which the element is moulded from plastics material.

* * * * *